United States Patent [19]

Geisen et al.

[11] Patent Number: 4,680,913

[45] Date of Patent: Jul. 21, 1987

[54] PROCESS FOR PRODUCING AIRTIGHT SEALING OF BUILDINGS

[75] Inventors: Pierre Geisen, Strasbourg; Jean-Claude Reillaudoux, Souffelweyersheim; Bernard Ducret, Schwindratzheim, all of France

[73] Assignee: Soprema S.A., Strasbourg-Neuhof, France

[21] Appl. No.: 572,409

[22] Filed: Jan. 20, 1984

[30] Foreign Application Priority Data

Sep. 29, 1983 [FR] France ..... 83 15687

[51] Int. Cl.[4] ..... E04B 1/66

[52] U.S. Cl. ..... 52/746; 52/404; 52/410; 52/506

[58] Field of Search ..... 52/746, 404, 408, 410, 52/506, 309.1, 411, 414

[56] References Cited

U.S. PATENT DOCUMENTS

| | | | |
|---|---|---|---|
| 2,365,629 | 12/1944 | Eckel | 52/506 |
| 2,697,857 | 12/1954 | Eckel | 52/506 |
| 4,000,595 | 1/1977 | Fortescue | 52/410 X |
| 4,223,502 | 9/1980 | Robinson | 52/506 |
| 4,393,634 | 7/1983 | McDermott et al. | 52/309.1 |

FOREIGN PATENT DOCUMENTS

| | | | |
|---|---|---|---|
| 2549993 | 5/1977 | Fed. Rep. of Germany | 52/408 |
| 2139942 | 5/1972 | France . | |
| 2226519 | 4/1973 | France . | |
| 2513282 | 9/1981 | France . | |
| 811680 | 4/1959 | United Kingdom | 52/408 |

*Primary Examiner*—J. Karl Bell

*Attorney, Agent, or Firm*—Erwin S. Teltscher

[57] ABSTRACT

Process for producing airtight sealing of buildings, characterized in that it consists in causing to adhere fully on the zone to be treated a manfactured sheet of constant thickness comprising a reinforcement of organc fibres covered in a mass of bituminous binder, so as to produce a continuous dressing, whatever the nature and the shape of the substrate.

9 Claims, 2 Drawing Figures

PROCESS FOR PRODUCING AIRTIGHT SEALING OF BUILDINGS

Figure 1:
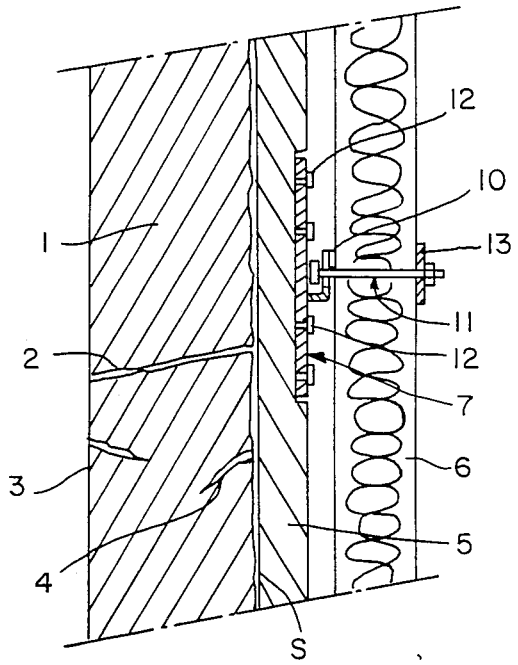

The present invention relates to improvements to the processes for producing airtight sealing of buildings, and is aimed at making these processes both easier to implement and more effective.

Recent investigations have demonstrated that the main problems of heat loss owe their origin more to a circulation of hot and moist air from the interior towards the exterior of a building than to a simple transfer of vapour through the walls resulting from a phenomenon of perviousness of the materials to water vapour. This is why attempts are made to ensure the best possible sealing of the walls of buildings, whatever their constituent materials, surface irregularities or discontinuities of the substrates.

The first processes proposed for this purpose consisted in nailing to the substrates individual plastic sheets, for example of polyethylene or polypropylene, fixed mechanically to the substrate and joined to each other with self-adhesive tape seals. The disadvantage of this system lies, on the one hand, in the perforations resulting from the nailing and, on the other hand, in the nature of these seals, which tear as soon as a difference in pressure causes the bulging of the plastic sheets.

Another known process consists in depositing on the substrate a continuous layer of a pasty, for example bituminous, material, which permits of course to match all the irregularities, but entails the unavoidable risk of irregularities in thickness, capable of ranging from some hundredths to several millimeters, which results in points of weakness in the dressing.

The invention makes it possible to eliminate all these disadvantages by virtue of a process for producing airtight sealing of buildings, characterised in that it consists in producing on the substrate which is to be sealed a continuous screen having no perviousness and no perforation, whether this substrate consists of identical of heterogeneous elements, or whether or not it comprises asperities or discontinuities.

To this end, this process consists in causing to adhere fully on the zone to be treated a manufactured sheet of constant thickness, strengthened by a reinforcement of organic fibres covered in a mass of bituminous binder so as to produce a continuous dressing whatever the nature and the shape of the substrate.

By virtue of such a process, in the case where it is necessary to ensure the junction between two sheets, or between a sheet and an accessory of the structure such as a pipe passing through a wall, the sheet is softened and it is shaped in accordance with the junction zone with an adequate overlap, which eliminates any risk of a point of weakness in the entire dressing.

This process is particularly suited to the subsequent attachment of an insulation over the dressing without perforating the latter, by applying, with pressure and heating in the surface zone of this dressing, perforated mounting plates permitting the flow of the bituminous material, acting after cooling as a support for this insulation.

Figure 2:
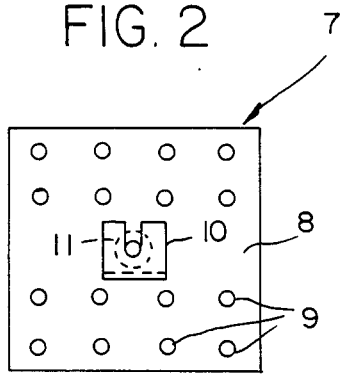

The invention will be illustrated by the following description of an embodiment, with reference to the attached drawing in which:

FIG. 1 shows, in vertical cross-section, a partition which has been sealed and insulated by the process according to the invention, and FIG. 2 shows, in a front view, the perforated mounting plate employed in the system of FIG. 1.

In this drawing, 1 refers to the partition to be protected, whose surfaces may be neither flat nor smooth, and may even comprise fissures such as 2, 3 or 4. According to the invention, on the surface S there is caused to adhere a sheet 5 whose nature will be described in greater detail later but which, essentially, consists of a mass of bituminous binder covering a reinforcement of organic fibres, the essential feature of this sheet being that it is continuous, whatever the irregularities of the substrate 1, so as to prohibit any circulation of air, for example at the site of joins or perforations, which the invention enables to be eliminated altogether.

For the fixing of an insulating layer 6, still without any perforation or any mechanical breach of the integrity of the sheet 1, the invention consists in using perforated mounting plates 7 such as that shown by way of example in FIG. 2. Such a mounting plate consists of a plate 8, perforated with holes 9, and having a bracket 10 in which can be hooked the head of a rod 11. The installation of this mounting plate is carried out by first softening the surface of the sheet 5 in the chosen location, then in applying the plate 8, a sufficient pressure being exerted so that, as this plate is embedded into the softened material of the sheet 5, this material flows through the holes 9 and, on cooling, forms a rivet over the exterior face of the plate 8, as shown at 12 in FIG. 1. With the plate thus immobilised, the rod 11 is hooked on it and the layer of insulation 6 is applied. The latter can be held in place, for example, by means of washers or discs 13 screwed on the end of the rod 11. The rod 11 can be replaced by a system comprising two blades, for example of metal, turned down at 90° each in an opposite direction, applied flat on the apparent face of the insulation.

As sheet 5 there may be used, according to the invention, any impervious material based on a bituminous binder, which may be oxidised, or modified with plastic polymers, for example of the type of atactic polypropylene (APP) or with thermoplastic polymers, for example of the type of styrene-butadiene-styrene (SBS) covering a layer of organic fibres in a sufficient quantity, which may be woven or non-woven, for example of polyester, polypropylene or polyamide. A sufficient quantity is to be understood as that which confers a satisfactory behaviour on the sheet in a vertical position, namely approximately 100 to 400 g/m$^2$. The sheet can be of any thickness, so long as this thickness will permit its application and welding to the substrate 1, namely at least approximately 3 mm.

The means by which the sheet 5 is applied so as to adhere to the substrate 1 can equally well be the softening of the sheet, for example with a blowlamp or hot air blower, or the use of a sheet which is self-adhesive when cold. In this latter case, however, it may be useful to fix the sheet by the top using mechanical means, to prevent any initiation of delamination.

The description of various types of sheets 1 which can be employed according to the invention will be given below by way of examples.

EXAMPLE 1

Sheet marketed by the Applicant Company under the name "SOPRASEAL 180".

In this example the sheet employed according to the invention has a total thickness of approximately 3 to 4 mm, the reinforcement of non-woven polyester in a concentration of approximately 180 g/m$^2$ and the elastomeric bitumen is a mixture of bitumen and of SBS thermoplastic polymer. The standardised specifications of this sheet are as follows:

tensile strength in N/5 cm (French Standard G 07-001),
longitudinal: 750,
transversal: 500.
elongation at the break (French Standard G 07-001),
longitudinal: 40%
transversal: 40%
static puncture resistance (French Standard P 84-352): 20 kg.
cold flexibility at −15° C.: no crack.
heat stability: 100° C.

Both faces of this sheet are protected by a thermofusible plastic film such as polypropylene.

This sheet is applied when heated with a propane blowlamp.

EXAMPLE 2

Sheet marketed by the Applicant Company under the name "SOPRELENE FLAM STICK".

In this example the sheet, of the same composition as the preceding one, has a thickness of 3 mm, but it has a self-adhesive underside which permits its application by direct pressure in the cold.

EXAMPLE 3

Sheet marketed by the Applicant Company under the name "SOPRASEAL 250".

In this example the sheet has a thickness of 4 mm, and the reinforcement of the same elastomer bitumen as before is of non-woven polyester fibres at a concentration of 250 g/m$^2$; its physical characteristics are as follows:

tensile strength: 800 in both directions,
elongation at the break: 50%,
static puncture resistance: 25 kg,
flexibility at −15° C.: no crack,
heat stability: >100° C.

Both faces of this sheet are also protected as those of Example 1.

This sheet is applied when heated with a propane blowlamp.

EXAMPLE 4

In this example, the bituminous mass is of the plastic polymer type, and contains APP. The reinforcement is of non-woven polyester fibres at a concentration of 150 g/m$^2$. The physical characteristics are:

tensile strength: 700 in both directions,
extension at the break: 30%
static puncture resistance: 15 kg,
flexibility at −10°: no crack,
heat stability: >120° C.

This sheet is applied when heated with a propane blowlamp.

Other advantages of the invention are the following:

The use of a membrane of elastomer bitumen meets the requirement of adaptation to the variations in the size of the discontinuities and of bonding to various types of substrates. The constant thickness of the manufactured product makes it possible, moreover, to avoid the points of weakness (in contrast to the products which are applied by trowel, of the type of Backlite, Flindcoat, and the like).

The possibility of softening the product with a flame makes it suitable for ensuring the join between standard parts and accessories (pipes, footing, mounting plates, and the like) which are not sensitive to flaming.

The advantage of the reinforcement in non-woven polyester, at an adequate concentration, is that it permits the fixing of the membrane by the top in order to avoid any sliding under the combined effect of the temperature (constant and equal to that of the interior, after the work is completed) and of time (the lifetime of the building, the removal of the wall cladding not being taken into consideration). It is, moreover, required to confer resistance on the bitumen at possible places where abnormal cracks could form (the dressing being fully welded, the deformation of an opening or of a crack is consequently reproduced wholly over the same width of the membrane as the width of the opening. The bitumen then diminishes in thickness in proportion to its deformation and, as a result of this, becomes more vulnerable to an underpressure or overpressure).

The installation of the dressing is carried out by welding vertical strips beginning at the foot of the building so that the upper strip overlaps the lower strip by 10 to 15 cm. The lengthwise overlaps are from 4 to 5 cm. The structural details are planned so as to ensure the joining of the dressing in its bottom part with the ground, eliminating any possibility of air circulation between the outside and the inside and in its top part with the roof (in the case of a terrace roof it is possible to provide the join between the dressing of the facade and the sealing dressing).

In the case of the self-adhesive sheets, the strips should be fixed by the top by mechanical means.

The installation of the sealing dressing is followed by the installation of the insulation: mineral wool or polystyrene. The panels are applied by simple pressure on the dressing which has previously been heated with a blowlamp or are impaled on mechanical supports, as indicated earlier. In addition to its simplicity of installation and particularly its effectiveness, the process according to the invention offers the advantage of a cost of manufacture which reaches, at the maximum, that of the most complex of the present processes.

We claim:

1. In a process for producing airtight sealing of buildings with the aid of a manufactured sheet of constant thickness, and with the aid of perforated mounting plates, said manufactured sheet including a reinforcement of organic fibers covered in a mass of bituminous binder, the steps comprising causing said manufactured sheet to adhere fully on a zone to be treated, said zone including a substrate, so as to produce a continuous dressing, and whatever the nature and shape of said substrate, attaching an insulation over said dressing without perforating said sheet, by applying said perforated mounting plates by hot pressing into a surface zone of said dressing, so that said perforated mounting plates serve, after cooling, as points of support for said insulation, and selecting said bituminous mass from the group consisting of oxidised bituminous binders, bitumens modified with thermoplastic polymers of the styrene-butadiene-styrene type, and bitumens modified with plastic polymers of the atactic polypropylene type.

2. A process according to claim 1, characterised in that the said sheet is applied by softening by heating by means of a blowlamp or by a hot air blower.

3. A process according to claim 1, characterised in that the said sheet is self-adhesive and applied by pressure when cold.

4. A process according to claim 1, characterised in that the organic fibres are employed in the woven or non-woven state and chosen from polyester fibres, polypropylene fibres and polyamide fibres.

5. A process according to claim 1, characterised in that the proportion of organic fibres is of the order of 100 to 400 g/m$^2$.

6. A process according to claim 1, characterised in that the sheet has a thickness of at least 3 mm.

7. A process according to claim 1, characterised in that in the case where joining is to be ensured between two sheets or between a sheet and an accessory of the structure such as a pipe passing through a wall, the sheet is softened and is shaped in the joining zone with an adequate overlap.

8. In a process for preventing heat losses through the walls of a building, and wherein the walls may have an arbitrary shape, comprising the steps of applying to said walls an airtight sealing including a continuous and imperious sheet of constant thickness of a composite material having surface zones, said material comprising a mixture of bitumen and of a thermal plastic polymer, said thermal plastic polymer having organic fibers embedded therein, so as to prevent circulation of air therethrough, softening the surface zones of said composite material, thereafter hot pressing mounting plates formed with perforations into the surface zones of said composite material, so that the softened material passes through said perforations, whereby said plates are immobilized upon the softened material having passed through said perforations, and having been allowed to cool, and subsequently applying an insulating layer to said mounting plates.

9. The process as set forth in claim 8, wherein said walls include a structural accessory, and further comprising the steps of applying an additional sheet similar to said continuous and impervious sheet to said walls in a sheet joining zone, softening said additional sheet, and joining said additional sheet to said continuous and impervious sheet so as provide for an adequate overlap between said sheets.

* * * * *